United States Patent [19]

Potter, III

[11] 4,009,881

[45] Mar. 1, 1977

[54] GAME APPARATUS

[76] Inventor: Orville J. Potter, III, Star Rte. 1 Box 333B, Bremerton, Wash. 98310

[22] Filed: May 30, 1975

[21] Appl. No.: 582,196

[52] U.S. Cl. ..... 273/115; 273/85 E

[51] Int. Cl.[2] ..... A63F 7/06

[58] Field of Search ..... 273/109, 115, 85 R, 273/94 R, 87.2, 176 H, 85 C, 85 D, 85 E, 85 F

[56] References Cited

UNITED STATES PATENTS

| | | | |
|---|---|---|---|
| 1,080,972 | 12/1913 | Jackson | 273/115 |
| 1,145,781 | 7/1915 | Mahoney | 273/105.2 |
| 2,118,084 | 5/1938 | Heinzelmann | 273/87.2 |
| 2,160,299 | 5/1939 | Zinngrabe | 273/85 R |
| 2,180,123 | 11/1939 | Smith | 273/85 R |
| 3,170,694 | 2/1965 | Dolce | 273/115 |
| 3,240,495 | 3/1966 | Ek | 273/85 F |

FOREIGN PATENTS OR APPLICATIONS

| | | | |
|---|---|---|---|
| 529,289 | 7/1931 | Germany | 273/85 R |
| 415,260 | 8/1934 | United Kingdom | 273/85 C |

*Primary Examiner*—Anton O. Oechsle
*Attorney, Agent, or Firm*—Seed, Berry, Vernon & Baynham

[57] ABSTRACT

A game apparatus including a frame and horizontal sheet of flexible material having a plurality of vertically displaceable localized areas and goals at opposite ends. A plurality of crankshafts are rotatably mounted beneath the sheet and interconnected thereto. Each crankshaft actuates a plurality of spaced-apart connecting rods fastened to the underside of the flexible sheet at the center of the displaceable localized areas. The rotation of a crankshaft thus displaces each localized area above or below the mean level surface of the sheet. The crankshafts corresponding to one team project beyond one side edge of the frame and the crankshafts corresponding to the opposing team project beyond the opposite side edge of the frame, thereby allowing opponents on opposite sides of the sheet to vertically displace the localized areas under their control.

A ball is placed on the top surface of the sheet, and the gradients caused by the vertical displacement of the localized areas upon rotation of the crankshafts causes movement of the ball. Players attempt to direct the movement of the ball toward the goals at opposite ends of the sheet.

2 Claims, 2 Drawing Figures

GAME APPARATUS

BACKGROUND OF THE INVENTION

1. Field of the Invention

This invention relates to a game apparatus and, more particularly, to a game apparatus in which a ball is propelled across a horizontal, flexible sheet toward a goal or ball receiving pocket at both ends of the sheet by gradients caused by displacing localized areas of the sheet above or below the mean playing surface.

2. Description of the Prior Art

Many games are known in which a ball rolls on a game surface. In the great majority of these games, motion of the ball is caused by striking the ball with another ball or object, or by streams of rapidly moving liquids or gases, such as air. Very few games have been devised where motion of the ball is caused solely by the ball's rolling along the gradient caused by deformations in the game's surface. The games that do utilize this principle generally produce deformations on the surface in only one direction. The games which cause deformations both below and above the game surface are complicated and bulky, and hence only a very few points on the game's surface can be controlled. This type of structure greatly reduces the control which a player can exercise over the path of a rolling ball, even when great skill is used.

SUMMARY OF THE INVENTION

It is an object of the present invention to provide a mechanism for displacing localized areas of the game surface, both above and below the mean level of the game playing surface.

It is another object of the invention to provide a mechanism for simultaneously generating a plurality of localized displacements of the game playing surface.

It is still another object of the present invention to provide a predetermined relationship between the plurality of displaced areas.

It is a further object of the present invention to utilize a connecting rod actuated by a crankshaft to positively displace a localized portion of a flexible, horizontal playing surface.

It is a still further object of the present invention to provide localized displacements on a playing surface in predetermined positions.

These and other objects of the present invention are accomplished by a game apparatus having a frame and horizontally disposed, flexible sheet with a plurality of vertically displaceable localized areas and goals at each end. A ball is rolled along the top surfaces of the sheet by gradients caused by displacing the localized areas above or below the mean level surface of the sheet. A plurality of localized areas are actuated simultaneously by a crankshaft driving a plurality of connecting rods secured to the bottom surface of the sheet at the center of each localized area. In this manner, a predetermined relationship is maintained between the displacements of each localized area. The crankshafts project beyond the side edges of the frame. Handles are secured to the cranks formed by bending the ends of the crankshafts and are rotated by opposing contestants on each side of the sheet to manipulate the ball into the goals at opposite ends of the sheet.

DETAILED DESCRIPTION OF THE PREFERRED EMBODIMENTS

Figure 1:
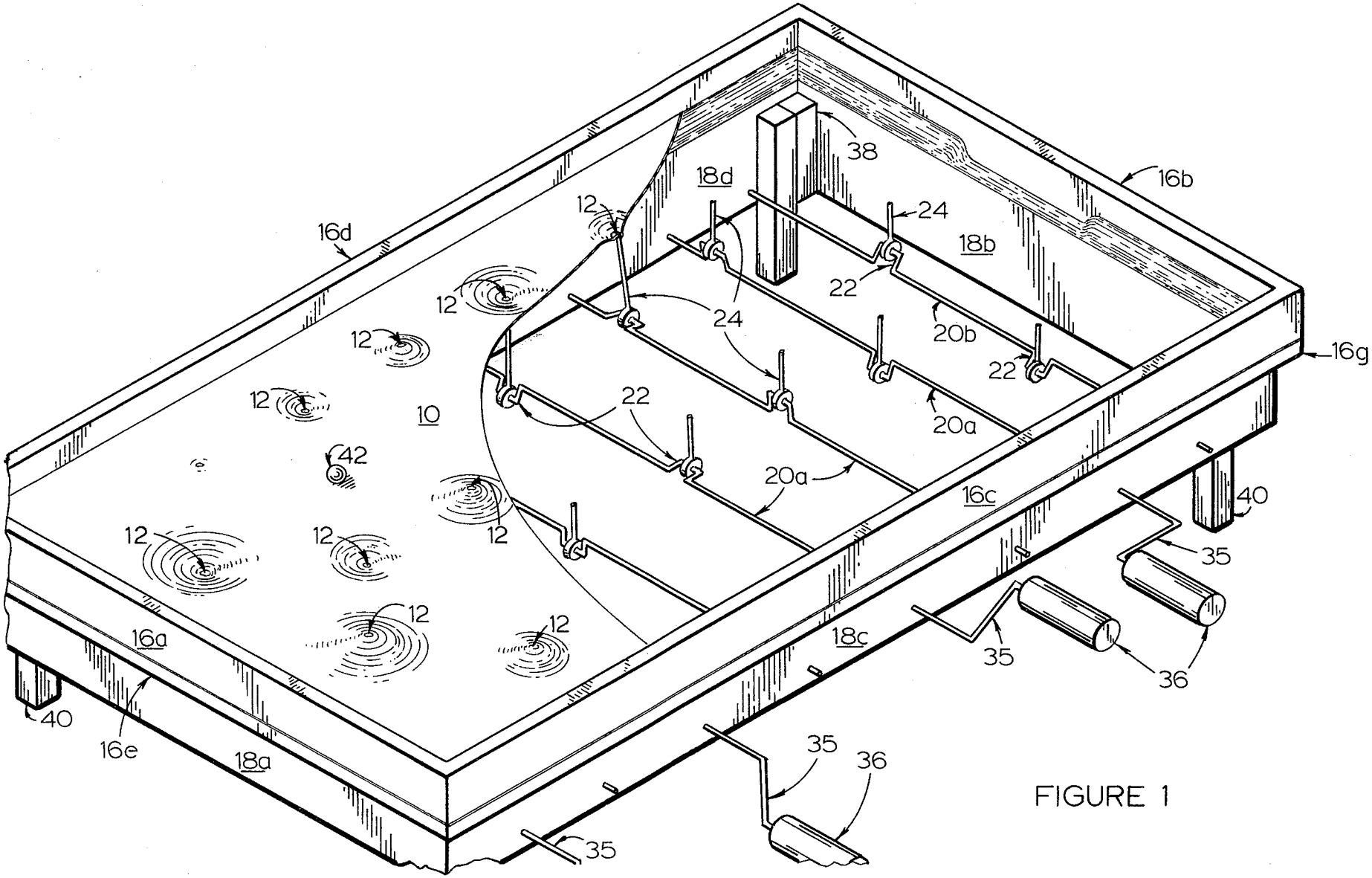
FIG. 1 is an isometric view of the game apparatus of the present invention with a portion of the playing surface cut away to show the actuating mechanism beneath the playing surface.

The game apparatus of the present invention, as shown in FIG. 1, includes a playing surface 10 fabricated from a rectangular sheet of flexible material having a plurality of localized areas 12 on its top surface.

In the preferred embodiment, the flexible sheet forming the playing surface 10 is stretched across the inner frame 18 and clamped in place by an outer frame 16. The preferred embodiment uses 6 mil. flexible vinyl as the playing surface 10 and wood for the frames 16, 18. However, many other materials may be used.

An alternative method of fastening the flexible sheet 10 to the frames 16, 18 is the use of a heat shrinkable material for the flexible playing surface 10. After the sheet is attached to one of the frames 16, 18, heat is applied, causing the sheet to shrink and become taut.

At each end of the playing surface 10, recessed goals 14 or pockets are formed by cutting notches into the top center of end pieces 18*a, b* of the inner frame 18. The pockets forming the goals 14 trap any ball entering the goal against the end walls 16*a,b* of the outer frame 16.

Figure 2:
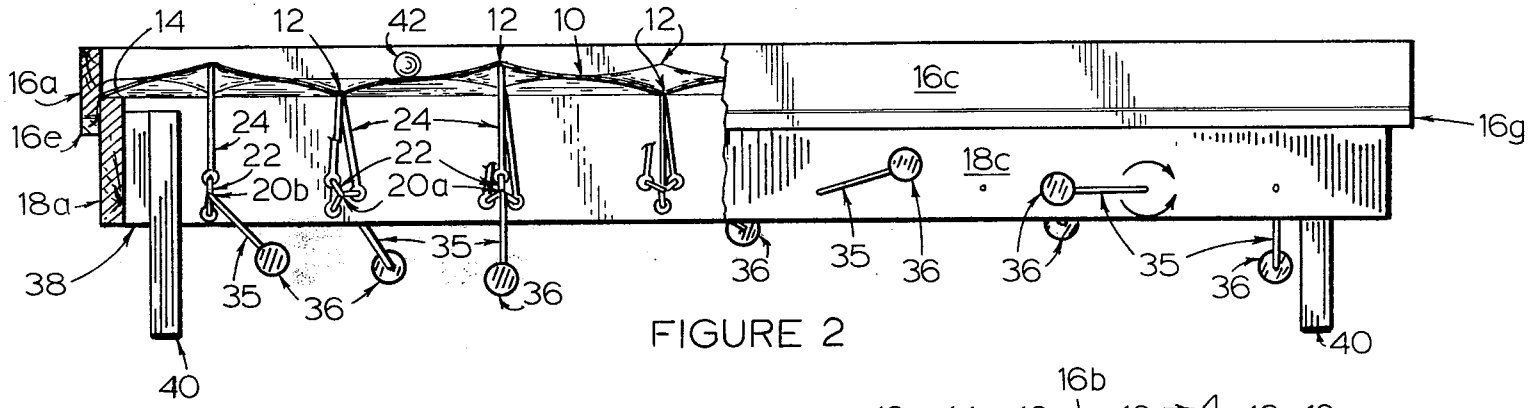
FIG. 2 is a side elevation view, partially in section, showing the manner in which the flexible sheet is secured to the frame and the connecting rods to the crankshaft.
Figure 3:
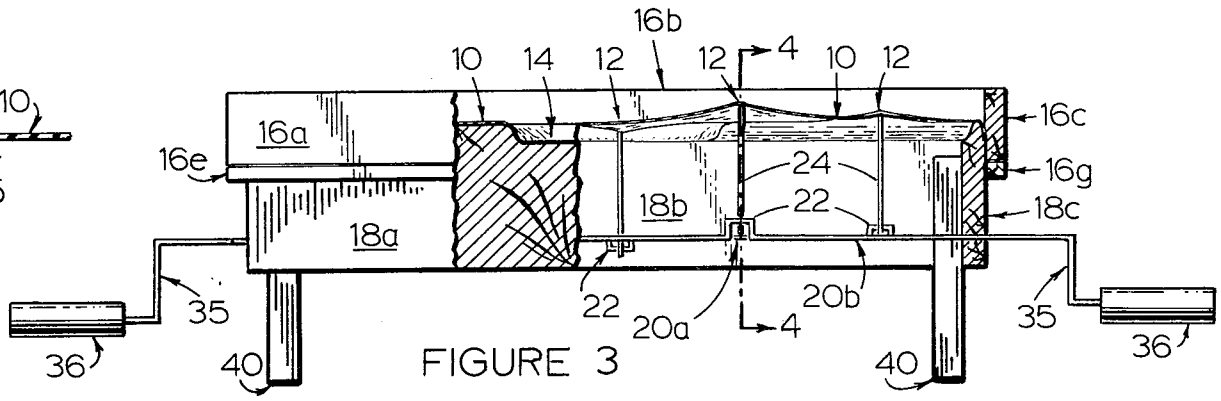
FIG. 3 is an end elevational view, partially in section, showing the placement of the connecting rods on one of the crankshafts.

The mechanism for displacing the localized areas 12, shown here as markings on the top surface of the sheet 10, is illustrated in FIGS. 1, 2 and 3. A crankshaft 20, preferably fabricated from a 3/16 inch cold-rolled steel rod, extends from one inner frame sidewall 18*c* to the other sidewall 18*d* beneath the playing surface 10. One crankshaft 20 is provided for each lateral row of localized areas 12. Since forces on the crankshafts are relatively small, no bearings are required between the crankshafts 20 and the inner frame 18. Instead, the crankshaft 20 are merely inserted through bores in the frame sidewalls 18*c, d.* Strength requirements for the crankshafts may be reduced by placing a lengthwise brace down the approximate center of the frame 18 with journals to support each crankshaft near its center (not shown).

Two basic crankshafts 20*a*, 20*b* are provided. The crankshafts 20*b* adjacent the goals 14 have two lobes 22, each positioned 180° from the other. These crankshafts 20*b* constitute the last defense between an opposing player and his goal 14. The remaining crankshafts 10*a* have three lobes, each lobe 22 being rotated 120° from the others. Positioning the lobes 22 in this manner allows the players to move the point of maximum displacement in sequence across the surface of the sheet, thus causing the ball to roll laterally across the game's playing surface instead of longitudinally toward either goal. This tactic could be used to increase the ball's velocity prior to creating a rise of depression with an end lobe to deflect the ball towards the opponent's goal. The strokes of both crankshafts 20*a*, 20*b* are the same. A long stroke is not required, and strokes on the order of ½ inch to 1½ inches are optimum.

Many variations, such as the number of lobes, the amount of rotation between lobes, and the stroke of the lobes can be used. By varying the length of the strokes, the area if deformation for each localized area 12 may be varied. Increasing the number of lobes 22 increases the number of points on the game surface that can be displaced. Similarly, the number of crankshafts can be changed, and multiple crankshafts can be rotated by one handle through the use of belts, chains or gears (not shown).

Each of the crankshaft lobes 22 displaces the playing surface 10 at a localized area 12 through a connecting rod 24. The connecting rods 24 are sufficiently rigid to withstand bending under compression. The length of the connecting rods is not critical. However, they should be of sufficient length so that their force vector on the surface 10 is substantially vertical. A length of three or four times the stroke length or greater is preferred. In one operational embodiment of the game apparatus, the connecting rods 24 are fabricated from ⅛ inch Delrin plastic rods which are heat-formed to shape. Pressure-molded plastic, steel or other material could be advantageously used.

Figure 5:
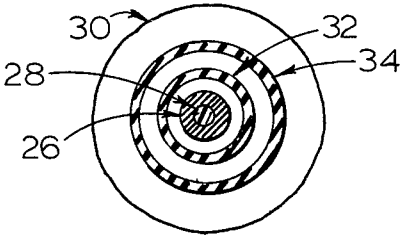
FIG. 5 is a cross-sectional view taken along the lines 5—5 of FIG. 4 showing the concentric welds and a washer which secure the connecting rods to the flexible sheet.
Figure 4:
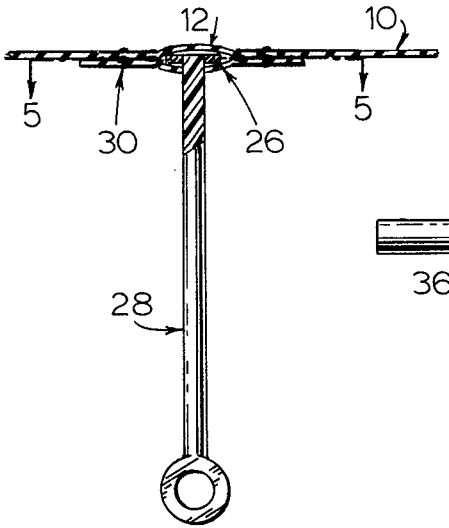
FIG. 4 is a cross-sectional view taken along the line 4—4 of FIG. 3 illustrating in detail the connection between a connecting rod and the flexible sheet.

The method of fastening the connecting rods 24 to the flexible sheet 10 is illustrated in FIGS. 4 and 5. Prior to forming the head 26 on the connecting rod shaft 28, a washer 30, fabricated from the same material as the flexible sheet, is slipped on the shaft 28. The head 26, which is substantially larger than the inside diameter of the washer 30, prevents removal of the washer 30 from the shaft 28. The washer 30 is thermally bonded to the bottom surface of the flexible sheet 10 beneath a localized area 12 by two concentric, circular welds 32, 34. The welds 32, 34 secure the washer 30 and thus the connecting rods 24 to the flexible sheet 10 and allow the connecting rod 24 to exert both upward and downward forces on the flexible sheet 10, thereby causing peaks and depressions. Alternative methods of securing the connecting rods 24 to the sheet 10, such as adhesive or rivets, may also be used. Alternatively, the connecting rod head 26 may be formed into various shapes, such as bars or crosses, to change the localized areas to a shape other than conical.

Alternating crankshafts 20 project through and beyond one sidewall 18*c* of the inner frame 18, and the remaining crankshafts 20 project through and beyond the opposite sidewall 18*d* of the inner frame 18. Each of the projecting ends 35 is bent into a crank, and handles 36 are fastened to the ends 35. These handles 36 are constructed of wood or other suitable material and facilitates rotation of the crankshafts 20.

The inner frame 18 is strengthened by braces 38 which also provide a base to which the legs 40 are secured. The legs 40 suspend the game above the surface on which it rests a sufficient height to allow a player's hands to clear the supporting surface while rotating the handles 36.

The ball 42 (FIG. 1) which rolls on the playing surface 10 can be of various sizes, but is preferably of a diameter of ½ to 1¼ inches. The density of the ball affects the speed of the game: a very dense ball beyond the fastest and a lighter ball the slowest. Generally, a dense ball will be desired.

Each of the localized areas 12 is colored to indicate to which player it belongs. Various pictures or designs can also be placed on the surface 10, as desired.

The game apparatus is designed to be played by two players, or by four players comprising two teams. The game can be constructed to accommodate more players by increasing the size of the surface 10 and the number of crankshafts 20.

Play of the game consists of various maneuvers of the ball 42 caused by different combinations of rises and depressions at localized areas 12 in the game surface 10.

Creating a depression near the ball 42 when it is rolling slowly causes the ball 42 to enter into a circular or elliptical orbit around the center of the depression. The ball 42 can then be directed in any direction by returning the localized area 12 to the mean level of the game surface 10 at just the right instant.

Increasing the ball 42 velocity can be accomplished by creating a depression in front of the ball 42 as it rolls over a localized area 12, then changing the depression to a rise as the ball 42 passes the center.

Changing the ball's 42 path is accomplished by creating a depression or rise in the ball's 42 course when the ball 42 is in a localized area 12 but not directed directly over the center. Normally the depression or rise created is not as deep or as high as that used when attempting to get the ball 42 to orbit.

The ball 42 can be moved laterally across the game's surface 10 between localized areas 12 of the same crankshaft 20 by rotating the crankshaft 20 such that depressions form in front of the ball as rises form behind the ball. Crankshaft lobe 22 arrangement can be such that crankshafts 20 are either "right-hand" or "left-hand" i.e., clockwise rotation causes the ball 42 to move laterally toward the player, and counterclockwise rotation causes the ball to move laterally away or vice versa. This maneuver is only effective if the ball 42 is rolling laterally such that it crosses very near the center of the localized areas 12 along the crankshaft 20. A skillful player can pass the ball 42 laterally as described and in a similar manner downfield between localized areas 12 of other crankshafts 20 that he controls.

Defensive maneuvers are used to counteract the offensive maneuvers described above. The ball 42 is blocked by creating a steep rise in front of the ball 42 as it rolls across a localized area 12. If the ball 42 is not rolling directly over the center of a localized area 12, the block results in a deflection.

The ball 42 can be intercepted and caused to orbit as in the offensive maneuver. As a defensive maneuver, the ball 42 is released back in the direction from which it came, thus creating a U turn.

Using these and other plays and combinations and variations of these plays, players score goals. After each goal is scored, the ball 42 is removed from the goal area 14 and dropped into play at the center of the game surface 10. The first player or team to score a predetermined number of points is the winner.

The embodiments of the invention in which a particular property or priviledge is claimed are defined as follows:

1. In a game apparatus wherein a ball adapted to roll upon the top surface of a horizontally disposed, flexible sheet is propelled across the surface of said sheet by actuating means for producing vertical displacements of said sheet at localized areas; the improvement whereby said actuating means comprises:

a plurality of rotatably mounted crankshafts extending beneath said sheet, half of said crankshafts extending beyond one side of said sheet and terminating in respective cranks, and the other half of said crankshafts extending beyond the opposite side of said sheet and terminating in respective cranks such that players on opposite sides of said sheet may rotate their respective crankshafts; and a plurality of spaced apart connecting rods rotatably secured to each of said crankshafts, each of said connecting rods having an annular head formed at the top end thereof, said heads being positioned between the lower surface of said sheet beneath localized areas and an annular washer bonded to said sheet by two concentric, circular welds such that said localized areas are vertically displaced by rotating said crankshafts.

2. In a game apparatus wherein a ball adapted to roll upon the top surface of a horizontally disposed, flexible sheet stretched across a rectangular frame is propelled across the surface of said sheet by actuating means for producing vertical displacements of said sheet at localized areas, said sheet having goals positioned at opposite ends thereof, the improvement whereby each of said goals comprise an area of said sheet depressed beneath the mean level surface of said sheet and having a sufficient depth to retain said ball, said depressed areas conforming to indentations in the top edge of said frame at opposite ends thereof having a width equal to the width of said goal whereby balls entering said goals are retained against the respective end walls of said frame.

* * * * *